United States Patent [19]

Raab

[11] Patent Number: 4,519,277

[45] Date of Patent: May 28, 1985

[54] CHAMPAGNE BOTTLE OPENER

[76] Inventor: Clifford G. Raab, 3977 Aladdin Dr., Huntington Beach, Calif. 92649

[21] Appl. No.: 647,357

[22] Filed: Sep. 4, 1984

[51] Int. Cl.[3] ..... B67B 7/06

[52] U.S. Cl. ..... 81/3.55; 81/3.57

[58] Field of Search ..... 81/3.46 R, 3.46 A, 3.34; D8/33, 40, 18

[56] References Cited

U.S. PATENT DOCUMENTS

| | | | |
|---|---|---|---|
| 2,516,439 | 7/1950 | Whiteley | 81/3.46 R |
| 2,856,804 | 10/1958 | Whiteley | 81/3.46 R |
| 4,479,406 | 10/1984 | Shoemaker | 81/3.46 A |

*Primary Examiner*—Roscoe V. Parker

*Attorney, Agent, or Firm*—Harvey S. Hertz

[57] ABSTRACT

A one-piece, hand-operated opener for plastic cork or cap removal. A frame of generally rigid material surrounds a keyhole shaped opening, the circular portion of said opening fitting over the head portion of a plastic cap press-fitted into the neck of a champagne bottle. The slot portion of the opening has a smaller lateral dimension permitting it to be forced between the downward edges of the cap head portion and a flange adjacent to the bottle neck extremity. The frame shape on either side of the slot section of the opening forms a ramp, the thickness of the frame thereat increasing in the direction of a butt portion extending from said frame at the end opposite the opening circular portion. Integral thumb and finger ears extend laterally opposite from the frame adjacent the circular opening portion.

12 Claims, 7 Drawing Figures

CHAMPAGNE BOTTLE OPENER

BACKGROUND OF THE INVENTION

1. Field of the Invention

The invention relates to bottle openers generally and more specifically to an opener for removing a force-fitted generally standard, plastic cap or cork from a bottle which may contain a fluid under pressure, such as champagne.

2. Description of the Prior Art

In the prior art, comparatively litte attention has been paid to the opening of champagne, since the self-generated internal pressure in a bottle of champagne operates to tend to eject the cork once the wiring or other restraint is removed. Hence, the corkscrew or similar opening devices for still wines are not required.

A relatively small prying or rocking of the cork generally effects final loosening and forceful ejection results. Such forceful ejection may resu.lt in a "geyser" of champagne and is to be avoided. A more gradual release of the pressure is much less likely to produce this result and avoids the cork projectile effect.

While it is possible to gradually remove the champagne cork or cap by hand without mechanical aids, some degree of skill is required and the average person is unlikely to be so skilled.

In the past, champagne and other sparkling wine bottles were sealed with real cork. However, mass-marketed champagnes and other sparkling wines are now usually sealed with a relatively standard force-fitted, plastic, hollow-stemmed cap. That form of cap is inexpensive and well-adapted to machine insertion.

In apparent recognition of the need for a sparkling wine, plastic cap removing device, at least one such device is currently offered for sale. That device has a hinge of flexible plastic material joining two similar flat body portions each with a handle extending therefrom opposite said hinge. The two body portions "sandwich" over the plastic cap head portion permitting cap removal by laterally rocking the cap to cause controlled pressure release while restraining the pressure-induced ejection force. Devices of that general character are relatively expensive and cumbersome. Moreover, the bendable section of plastic material must be separately bonded to the two body portions or if integral the material of the hinge is that of the body portions and handles, then the overall durability will be reduced. This is true because a sufficiently flexible material to provide the bendable hinge will be less than optimum for the body portions and handles.

The manner in which the invention provides a highly commercial improvement which is both simple, easily fabricated and inexpensive will be evident as this description proceeds.

SUMMARY

The device of the invention is best adapted for removal of the aforementioned plastic sparkling wine cap. The invention is embodied as a one-piece, generally flat part having a "keyhole" shaped opening through its thickness. The "keyhole" has a substantially circular portion and a slot portion in communication with said circular portion. The generally circular portion of that opening is sized to fit over the aforementioned relatively standard plastic cap, and the edges of the "keyhole" opening form a frame around the "keyhole" with the lateral width of the slot portion being such as to permit the frame to slide between the downward edges of the plastic cap and the usual integral flange on the bottle neck.

In using the term "nominally flat", the fact that the device of the invention is not of uniform thickness is not precluded. In fact, the edges of the frame defining the said "keyhole" opening form ramps rising away from the keyhole circular portion toward an extended butt end so that a manual force applied against said butt end or in the general direction from said butt toward said circular opening tends to exert an upward prying action against said plastic cap.

A pair of lateral tabs, one extending outward from each side of said frame opposite said circular portion of said opening, provide thumb and finger engagement during the bottle opening process.

The invention will be more fully understood from the detailed description and drawings following.

DETAILED DESCRIPTION

Figure 1:
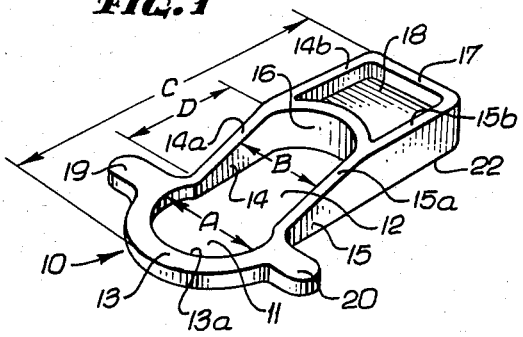
FIG. 1 is a prospective view of a typical embodiment of the invention.

Referring now to FIG. 1, a representative and generally preferred embodiment of an opener according to the invention is depicted at 10. The device is of rigid material and may be of metal, plastic, or similar rig.id material. As a metal part it is adapted to such economical processes as die casting. However, if fabricated in any of the common well-known plastic materials, it is more economically moulded in accordance with well-known methods. The actual process employed is subject to selection by persons of skill in those arts and is not, per se, a part of the invention. The device 10 includes a "keyhole" opening comprising a circular portion 11 and a slot portion 12. The "keyhole" opening is defined by frame portions of 10 at 13, 14, 15, and at the internally rounded portion 16 adjacent to an extended butt projection 17. The butt portion of the one-piece moulded device is shown with a recessed portion 18, basically for economy of material use.

A pair of tabs 19 and 20 extend laterally for thumb and finger engagement; their specific function being further described hereinafter.

Figure 2:
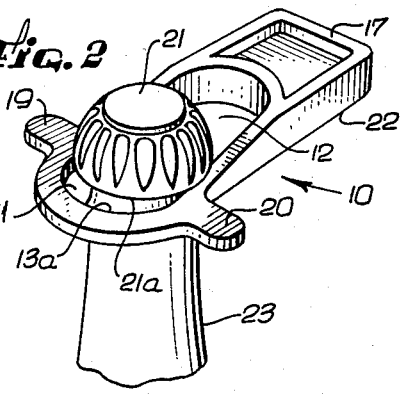
FIG. 2 is a prospective view of the opener of the invention according to FIG. 1 as it is placed over the neck of a bottle.

In FIG. 2, the device 10 is shown emplaced over the neck of a bottle 23, from which plastic cap 21 is to be removed. The device is only slightly shifted from the position at which it was placed over cap 21, the circular portion 11 of the keyhole being only slightly larger in diameter than the maximum outside diameter of cap 21.

Figure 3:
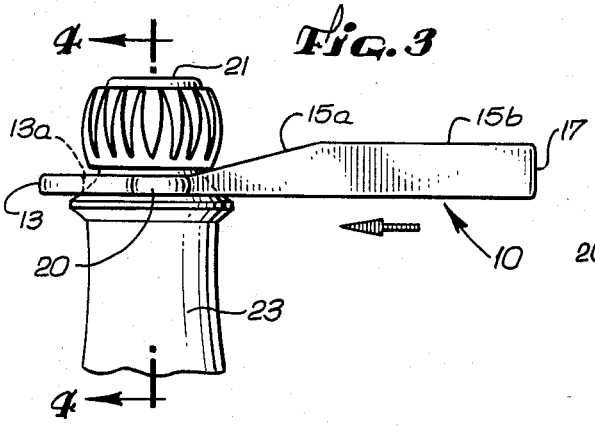
FIG. 3 is a side view of FIG. 2.

FIG. 3 shows a side view of FIG. 2 as the internal frame edge 11*a* bounding the circular opening portion would relate to cap 21 at the time of placement thereover. The sectional view of FIG. 4 indicates how the frame portions 14 and 15 fit within the clearance between bottle flange 23*a* and the bottom outer edge 21*a* of cap 21 at lowest ramp elevation and before any substantial upward prying action takes place.

Figure 4:
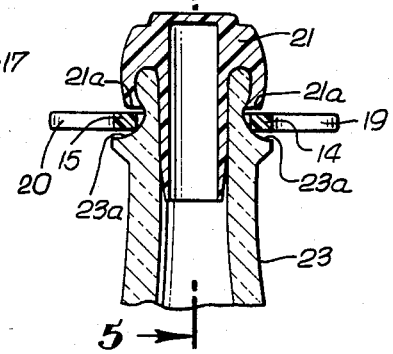
FIG. 4 is a sectional view taken as indicated on FIG. 3.
Figure 5:
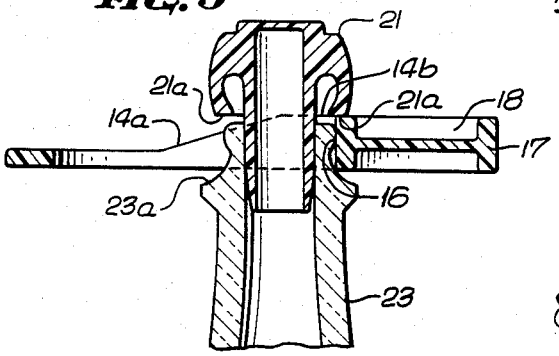
FIG. 5 is a sectional view taken as indicated on FIG. 4 with the ramp of the opener substantially fully engaged.

FIG. 5 is a sectional view taken as specified on FIG. 4 with the exception that the device 10 is shown pressed in the direction of the arrow on FIG. 3 such that the ramps 14*a* and 15*a* acting between bottle flange 23*a* and cap lower edge 21*a* have partially elevated the cap 21.

From FIG. 2 and 4 the preferred hand position of the operator can be described. The hand is positioned so as to grip over the cap 21 and the opener device 10 with the heel of the palm bearing against the butt 17. If it is assumed that the right hand is used, the thumb may be assumed to bear against the tab 20 and a middle finger can bear against tab 19. This hand arrangement facilitates easy application of the translation force (arrow of FIG. 3). The index finger or another middle finger may overlap the cap 21 and, along with the overall hand containment, assist in restraining the pressure driven tendency of cap 21 to eject precipitously.

Figure 6:
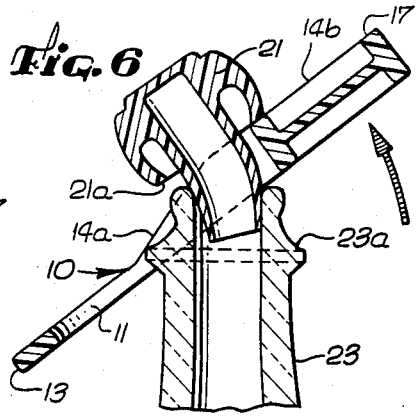
FIG. 6 illustrates the normal prying action for removal of a cap as a next step from FIG. 5.

With the hand placed as aforesaid, the opening device can be rotated as illustrated by the curved arrow in FIG. 6. During this action, the pressurized gas within the bottle is released gradually at the same time as unrestrained ejection of cap 21 is prevented.

While none of the dimensions of the device 10 are critical, as long as they fulfill the functional requirements, an embodiment according to FIG. 1 was found to be practical and effective with dimension A at $1\frac{1}{4}$ inches, and dimensions B, C, and D at 1 1/16, $4\frac{1}{4}$ and 1 inches, respectively. The slopes of ramps 14*a* and 15*a* were on the order of approximately 12 degrees, and portion 15*b* is preferably parallel to flat bottom edge 22.

Figure 7:
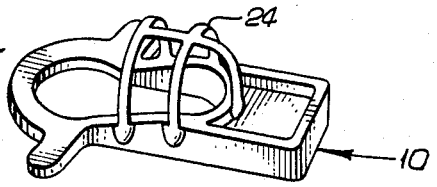
FIG. 7 is prospective view of an alternative embodiment of the invention.

Referring now to FIG.7, an alternative embodiment shows an integral cage 24 which provides further cap or cork ejection restraint without inhibiting the placement of the device over the cork or cap as.previously described the cage 24 coming into place over the cap 21 when the device 10 is in the position depicted in FIG. 5. Variations within the inventive concepts will suggest themselves to those of skill in this art and accordingly, it is not intended that the scope of the invention be regarded as limited to the specific showings of the drawings or to the foregoing description. For one example of a variation, the ramps could be placed on both faces of the device rather than on one side as illustrated. The drawings and descriptions are intended to be typical and illustrative only.

I claim:

1. A device for removing sparkling wine bottle caps of the type having a head portion and an integral stem, press-fitted into a bottle having a flange adjacent its top end, comprising:

a one-piece elongated, nominally flat member of rigid material forming a frame about a "keyhole" opening through the flat projection of said member, said keyhole opening having a generally circular portion adjacent a first end of said member and a slot portion extending from said circular portion toward a second end of said member, said circular opening portion having a diameter greater than that of said cap and said slot portion having a lateral dimension within said frame less than the diameter of said head portion of said cap;

a butt portion extending beyond said slot portion to said second end;

and ramps sloped upward toward said butt portion and being formed in said frame laterally bounding said slot portion to apply a lifting force to said cap with respect to said bottle flange in response to a compression force applied in the direction from said second end to said first end.

2. A device for removing sparkling wine bottle press-fitted caps comprising:

a one-piece elongated frame nominally flat and having a key-hole shaped opening therethrough, said opening having a substantially circular portion adjacent a first end of said frame and a joined slot portion of smaller lateral dimension extending therefrom toward a second end of said frame;

a butt portion extending beyond said second end; and an integral ramp portion along at least one side of said frame adjacent said slot portion, said ramp portion being formed by an increasing dimension of said frame in the direction normal to the flat plane of said frame and toward said butt, said opening circular portion permitting insertion over the head of said champagne bottle cork and said ramp portion engaging the underside of said cork and exerting an upward prying action as a force acting generally parallel to the plane of said flat bottom is applied at least to said butt.

3. A device for removing a plastic cap, said cap having a head portion and a stem press-fitted into the neck of a bottle containing a fluid under pressure without explosive ejection, comprising:

a substantially flat frame member including a clearance opening means for placing said frame over said cap head portion;

ramp means associated with said frame for applying an upward prying pressure to the bottom edge of said cap head portion with respect to a portion of the neck of said bottle translation force against said in response to a hand induced frame member in a plane normal to the longitudinal axis of said bottle.

4. The device according to claim 3 in which said frame further defines a slot opening extending from said clearance opening, said slot opening being sized such that the portions of said frame adjacent thereto slide between said cap head bottom edge in response to said hand induced translation force.

5. The device according to claim 3 in which said frame includes at least one tab integral with said frame and extending outward therefrom adjacent said clearance opening.

6. The device according to claim 3 in which a pair of said tabs is provided, each on an opposite side of said clearance opening for finger and thumb engagement.

7. The device set forth in claim 1 further defined in that at least one integral tab is provided extending generally radially outward with respect to said circular portion of said keyhole opening.

8. The device set forth in claim 1 further defined to include a pair of integral tabs extending laterally outward from said frame opposite said circular opening portion.

9. The device according to claim 8 further defined in that said tabs are located to extend generally radially outward with respect to said circular opening portion, to provide finger and thumb engagement during cap removal.

10. The device according to claim 2 in which said ramp portions of said frame are extant on one of the surfaces of said nominally flat frame, the other surface of said frame being substantially planar, said planar surface being intended to face downward and away from said cap during use.

11. The device according to claim 2 further including a pair of outwardly extending finger and thumb engaging tabs integral with said frame and adjacent said circular portion of said keyhole opening.

12. The device according to claim 10 further including a pair of outwardly extending finger and thumb engaging tabs integral with said frame and adjacent said circular portion of said keyhole opening.

* * * * *